United States Patent [19]

Mascher et al.

[11] Patent Number: 4,459,981

[45] Date of Patent: Jul. 17, 1984

[54] BREATHING BAG FOR CLOSED CYCLE RESPIRATOR

[75] Inventors: Werner Mascher; Stefan Zloczysti; Bernd Woicke; Klaus Haertle, all of Berlin, Fed. Rep. of Germany

[73] Assignee: Auergesellschaft GmbH, Berlin, Fed. Rep. of Germany

[21] Appl. No.: 380,217

[22] Filed: May 20, 1982

[30] Foreign Application Priority Data

Mar. 20, 1981 [DE] Fed. Rep. of Germany ..... 3111795

[51] Int. Cl.[3] ..... A62B 7/00

[52] U.S. Cl. ..... 128/202.26; 128/205.12; 128/205.17

[58] Field of Search ..... 128/202.26, 205.12, 128/205.13, 205.17

[56] References Cited

U.S. PATENT DOCUMENTS 1,013,541 1/1912 Fleuss et al. ..... 128/205.12

2,677,371 5/1984 Loredo Serra ..... 128/205.12

4,233,971 11/1980 Gronan et al. ..... 128/205.12

FOREIGN PATENT DOCUMENTS 368866 7/1973 U.S.S.R. ..... 128/205.12

*Primary Examiner*—Henry J. Recla

*Attorney, Agent, or Firm*—Carothers & Carothers

[57] ABSTRACT

A closed cycle respirator includes a breathing bag, the bottom of which is in communication with a canister containing a chemical that binds carbon dioxide and water vapor and liberates oxygen. Inside the breathing bag there is a distributor that guides the regenerated respiratory air flowing up from the canister laterally in the direction of the breathing bag's side walls but keeps that air largely away from the side of the bag that lies against the chest of the wearer. The reason for directing the air through the bag in this manner is to reduce the temperature of the air before it is inhaled again.

9 Claims, 2 Drawing Figures

BREATHING BAG FOR CLOSED CYCLE RESPIRATOR

In closed cycle respirators, in order to regenerate the exhaled air, use is made, for example, of chemical canisters that develop oxygen and bind carbon dioxide, in the process of which the chemical reaction taking place in the chemical canister is of an exothermic character. The consequence is that when using the apparatus in order to breathe, the breathing bag and the regenerated respiration air to be inhaled become heated. In order to reduce as far as possible the physical stresses on the wearer of the apparatus which set in under these conditions, provision must be made, on the one hand, appropriately to cool the inhalation air in the breathing bag and, on the other hand, to provide thermal and contact protection for the chemical canister and the breathing bag.

Consequently, the basic task of this invention is to create and so construct a breathing bag for closed cycle respirators that, on the one hand, there is a reduction in the temperature of the air to be inhaled and, on the other hand, the contact temperature on the wearer's side of the apparatus (the body side) is reduced in the region of the breathing bag.

The advantages to be obtained with the invention reside, in particular, in that, by the special arrangement and construction of air distributors within the breathing bag, the warm air emerging from the regeneration canister is deflected towards the side faces of the breathing bag, thereby making possible a better heat exchange with the surrounding atmosphere so that the air to be inhaled attains a lower temperature. In addition, due to the special form of construction of the air distributor, it is ensured that the air to be inhaled and entering the breathing bag from the chemical canister is, for the most part, kept away from the side of the breathing bag facing the respirator wearer's body.

The preferred embodiment of the invention is shown in the appended drawings and will be described in greater detail in the following.

Figure 1:
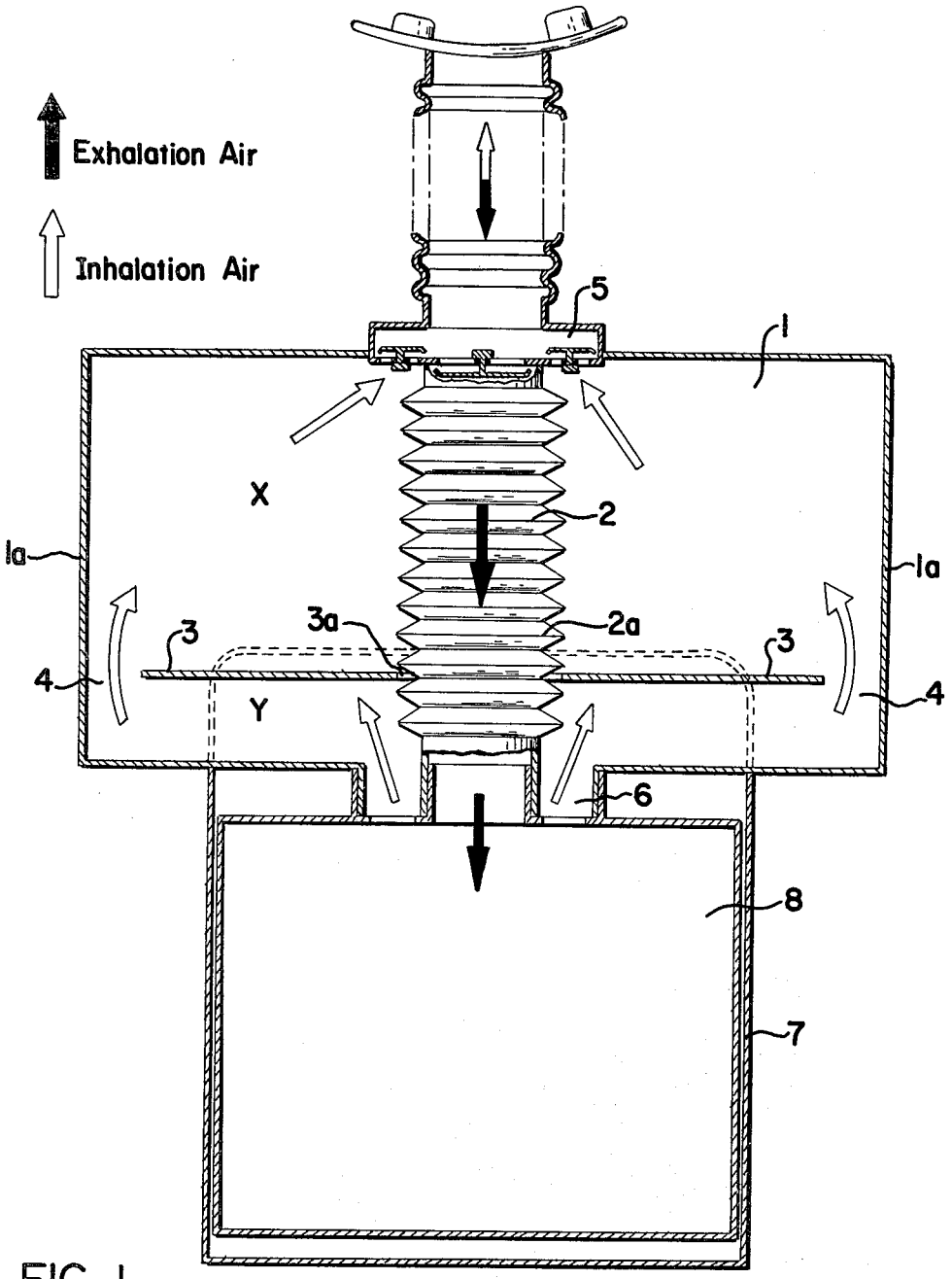
Figure 2:
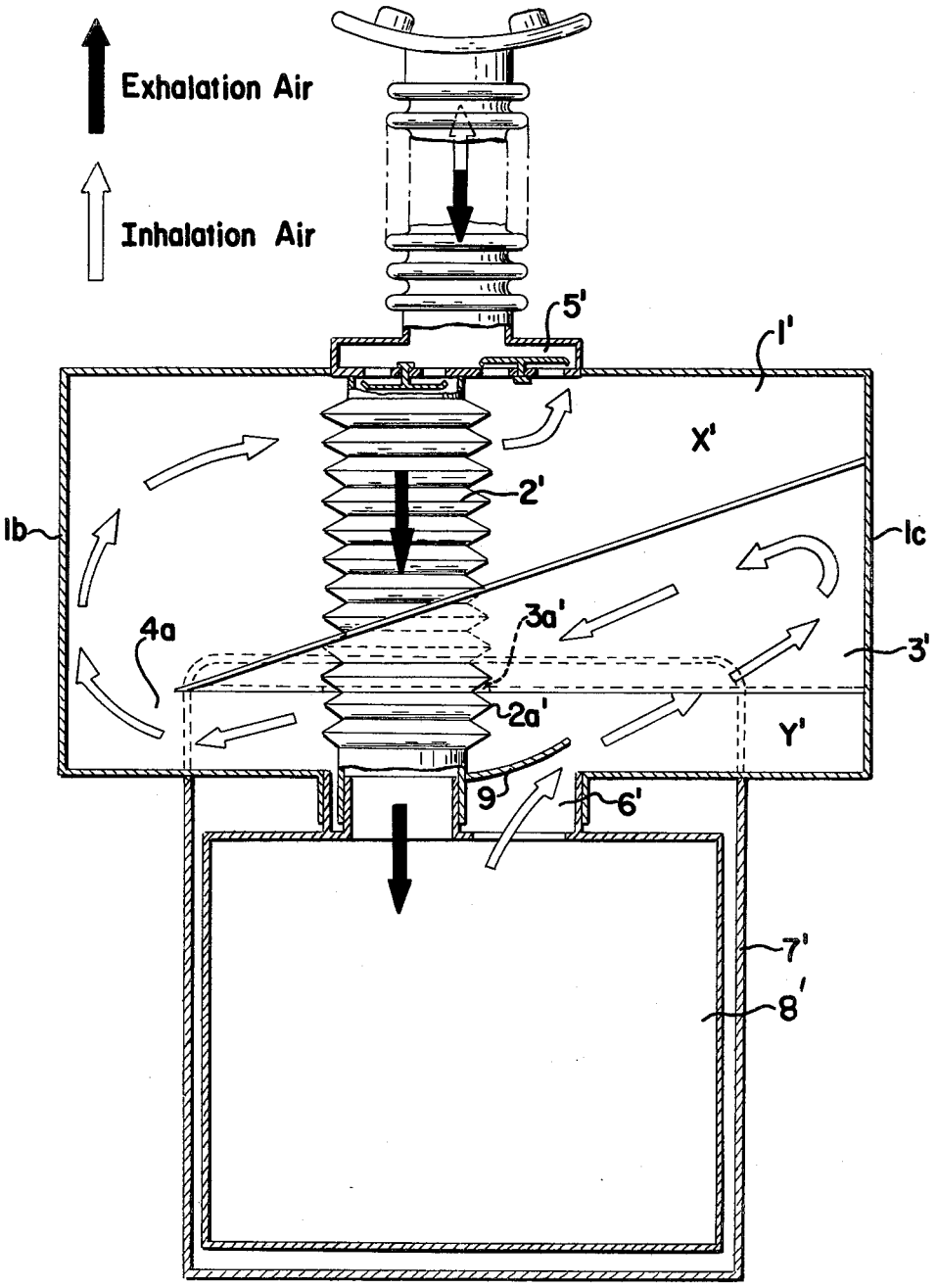

FIG. 1 presents a schematic drawing of the respirator in which the inhalation air coming from the chemical canister enters the breathing bag symmetrically, and FIG. 2 is a modified schematic drawing of the respirator in which the inhalation air coming from the chemical canister enters the breather bag asymmetrically.

As may be seen from FIG. 1, arranged symmetrically in the breathing bag 1 is a bellows-type hose 2 surrounded by a plate-like air distributor 3 which is installed in the approximately lower third of the breathing bag and which divides the breathing bag into two superimposed chambers x and y. The distributor is a substantially flat plate with a hole 3*a* through the center for the hose. One of the folds 2*a* of the hose overlies the edge of hole 3*a*. The longitudinal edges of the distributor plate are secured to the front and back walls of the bag. The distributor and bag may be made of the same material. Airgaps 4 are formed between the air distributor 3 and the side walls 1*a* of the breathing bag. By these measures, the warm regenerated respiration air which is to be re-inhaled is forced to flow upwardly along the side faces 1*a* of the bag and to travel from the chamber y into the chamber x in order to be cooled by the cooler outside walls of the chamber x of the breathing bag 1. The direction of flow through the breathing bag 1 is indicated by the arrows. Inhalation valves in chamber 5 open during inhalation.

As a result of the special arrangement of the air distributor 3 in the breathing bag 1, which divides the breathing bag into two chambers x and y with different heat zones when the respirator is in the operating state, a respiratory air guidance is ensured which makes possible an optimum thermal exchange by the warm inhalation air flowing through the air passages 6 from the chemical canister 8 to the breathing bag 1.

The chemical canister is surrounded by a protective sheath 7, which extends up along the breathing bag on the wearer's side of the respirator adjacent the wearer's body, thus covering the heated breathing bag region of the chamber y. By this means, additional protection against contact is obtained.

In the modification shown in FIG. 2 the air inlet 6' from the chemical canister 8' to the breathing bag 1' is off center. In the upper part of the inlet passage there is a flap valve 9 that swings upwardly to open the passage when the wearer of the respirator inhales. Regenerated air from the canister then enters the breathing bag, where it is guided by the distributor plate 3' toward one side wall 1*c*. The air is directed in this manner by the flap valve and because the distributor is inclined longitudinally. It is also inclined transversely where it is secured to side wall 1*c* of the bag. The front edge of the distributor plate is secured throughout its length to the front wall (not shown) of the bag. The horizontal lower edge of the distributor is secured to the side of the bag adjacent the wearer's body. The rest of the distributor plate slants down toward the opposite side wall 1*b* of the breathing bag, from which it is spaced to form an air gap 4*a*. The distributor is provided with an opening through it, through which the exhalation hose 2' extends.

When the regenerated air enters the bottom of the breathing bag the distributor directs it toward and against side wall 1*c* of the bag. The direction of the flow then is reversed and the air flows back toward the opposite side wall 1*b* of the bag and up through air gap 4*a* into the upper part of the bag, which the air leaves through inhalation valve chamber 5'.

According to the provisions of the present statutes, we have explained the principle of our invention and have illustrated and described what we now consider to represent its best embodiment. However, we desire to have it understood that, within the scope of the appended claims, the invention may be practiced otherwise than as specifically illustrated and described.

We claim:

1. A closed cycle respirator including a breathing bag having upper and lower open ends, side walls and front and back walls, means for adapting said breathing bag to be worn on ones chest, a canister containing a chemical that binds carbon dioxide and water vapor and liberates oxygen to flow regenerated respiratory air up into said bag, means for fluidically connecting said canister to said lower open end of said bag and means for connecting the upper open end of said bag to a user for breathing, the improvement comprising a distributor member secured within said bag to said front and back walls and extending generally in a direction transverse to said upper and lower ends and thereby vertically dividing said breathing bag into superimposed upper and lower chambers, said distributor member being spaced from at least one of said side walls to laterally guide regenerated respiratory air flowing up from said canister into said breathing bag toward said side walls.

2. A closed cycle respirator in accordance with claim 1, characterized in that the lower of said breathing bag chambers is smaller than the upper chamber.

3. A closed cycle respirator in accordance with claim 1, characterized by an opening for respiratory air from the chemical canister to enter the bottom of the breathing bag which is positioned centrally thereof, and air-gaps provided between the air-distributor and said side walls of the breathing bag.

4. A closed cycle respirator in accordance with claim 3, characterized in that the air distributor is firmly attached to the breathing bag on the back side thereof to be positioned next to the respirator wearer's body and also on the opposite front side.

5. A closed cycle respirator in accordance with claim 1, with an asymmetrical air inlet provided from the chemical canister into the breathing bag and characterized in that a flap-valve is mounted in said air inlet for admitting air from the canister into the breathing bag and the air distributor is positioned to direct such admitted air over only one of the breathing bag's side walls, one side of the air distributor being firmly attached to said one side wall so that the respiratory air flowing through the breathing bag is forced to have its direction reversed after making contact with said one side wall of the bag, and said distributor further positioned to direct this flow of respiratory air finally back across the bag and against the opposite side wall of said bag such that a further reversal in air flow direction takes place in an air-gap provided between said opposite side wall and the adjacent side of said distributor.

6. A closed cycle respirator in accordance with claim 5, characterized in that the air distributor in the breathing bag is inclined relative to the front side and to said one side wall of the bag.

7. A closed cycle respirator in accordance with claim 1, characterized in that the air distributor is provided with an opening through which a bellows type hose for exhalation passes, said opening being covered by a fold of said bellows.

8. A closed cycle respirator in accordance with claim 1, characterized in that the air distributor and the breathing bag are made of the same material.

9. A closed cycle respirator in accordance with claim 1, characterized in that the back side of the breathing bag is positioned for lying adjacent the respirator wearer's body and is covered on the outside in the region of the lower chamber by a protective sheath associated with the chemical canister.

* * * * *